United States Patent [19]

Pacione

[11] Patent Number: 4,822,658

[45] Date of Patent: Apr. 18, 1989

[54] CARPET BACKING AND INSTALLATION SYSTEM

[76] Inventor: Joseph R. Pacione, 127 Elgin Street, Thornhill, Canada

[21] Appl. No.: 136,953

[22] Filed: Dec. 23, 1987

[51] Int. Cl.[4] ..... B32B 3/00; B32B 33/00

[52] U.S. Cl. ..... 428/95; 428/40; 428/86; 428/100; 428/223

[58] Field of Search ..... 428/40, 95, 100, 86, 428/223

[56] References Cited

U.S. PATENT DOCUMENTS

| | | | |
|---|---|---|---|
| 3,817,015 | 6/1974 | Frangos | 428/100 |
| 3,858,269 | 1/1975 | Sutton et al. | 16/16 |
| 4,012,544 | 3/1977 | Richards | 428/100 |
| 4,350,721 | 9/1982 | Nagase | 428/33 |
| 4,361,610 | 11/1982 | Roth | 428/95 |
| 4,405,668 | 9/1983 | Wald | 428/40 |
| 4,581,269 | 4/1986 | Tilman | 428/62 |
| 4,581,274 | 4/1986 | Johns et al. | 428/95 |
| 4,671,976 | 6/1987 | Vidal | 428/40 |
| 4,673,603 | 6/1987 | Roth | 428/100 |

OTHER PUBLICATIONS

VELCRO Fastening Systems pamphlet—2 pp.

Total Learning Concept, pp. 21–24; 141–144; 155–158.

The How-To Handbook of Carpets; A. S. Garstein; Van Nostrand Reinhold Company (1979), Chapters 11–19.

*Primary Examiner*—Marion C. McCamish

[57] ABSTRACT

A novel carpet construction provides a secondary backing layer adhered to the primary backing layer in which the carpet pile is secured. The secondary backing layer incorporates a layer of downwardly depending loops which can serve as a resilient undersurface, in the manner of an underpad, and also to secure the laminated carpet structure to the floor. A hooked type construction used in combination with the subject carpet has a plurality of upwardly extending hooks to engage the looped layer of the carpet, and an adherent under surface, for making adhesive contact with the floor surface. The carpet construction can include a foam interlayer sandwiched between the primary and the secondary backing layers. The hooked tape can be laid as a perimeter attachment surface, or in intermediate locations also.

16 Claims, 2 Drawing Sheets

CARPET BACKING AND INSTALLATION SYSTEM

FIELD OF THE INVENTION

This invention relates to a new carpet formulation and in particular to a new carpet backing for use in combination with a new installation device, and to a novel carpet installation system.

BACKGROUND OF THE INVENTION

At the present time, most mass produced carpets are either of tufted or woven construction.

Tufted carpets are made by needling pile yarns into a supporting pre-woven or non-woven fabric, called the primary backing. the woven fabric can be of jute or polypropylene, and the non-woven fabric is usually of polypropylene.

After the pile tufts have been needled into the primary backing, they are bonded to the primary backing, usually by way of a bonding agent, such as latex or other suitable adhesive material. It is common practice to add a secondary backing of woven or spun-bonded man-made fabrics or of jute, which is adhered, by pressing the backing onto the latex while still tacky. This form of construction is referred to as "tufted" carpet which is usually installed upon an underpad, the tufted carpet generally having little or no inherent tread resiliancy of its own.

The installation technique most commonly utilized with such a carpet is referred to as the "tackless" or "smooth-edge" form of installation because of the absence of any visible fasteners, thus presenting a carpet having a "smooth edge" appearance without carpet tacks.

This system was originated in 1938 by the Roberts Company. In this method, strips of plywood of approximately ¼" thickness, by 1½" width and in four foot lengths are installed around the perimeter of the room or the area to be carpeted. The strips are available either without nails or with pre-started nails and can be either glued or nailed to the floor. The strips have two staggered rows of steel pins, projecting points uppermost and inclined laterally at an angle of 60° for installation outwardly inclined towards the wall.

With this system of installation, the carpet is placed in its approximate position on the floor and is stretched by means of the use of a power stretcher or knee kicker. Stretching in this system is essential to compensate for expansion and to take out or prevent wrinkles or buckles which will otherwise develop in use, which are unsightly and also present a tripping hazard and can shorten the life of the carpet by undue wear of such wrinkled portions.

In using the tackless installation system, the carpet must possess a sufficient degree of resilience in order that it can stretch resiliently on installation. Stretch is important to provide adequate residual tension in the carpet and on the steel pins at the perimeter of the carpet to ensure that the pins retain their grip and hold the carpet adequately secured.

In order to achieve adequate anchoring of a carpet, it is necessary that the steel pins grip into the secondary backing of the carpet. Thus, the secondary backing and the bond between the primary and secondary backing must be substantial and sufficiently rigid to provide an adequate substrate for the pins to grip and to prevent the carpet from moving off the pins and coming loose from the floor. The rigidity required of tufted carpets to afford the requisite pin holding characteristics make them hard to handle especially as the latex often has a filler or hardener, commonly referred to as "clay", mixed with it to add mass and stiffness, and provide a heavy carpet with adequate dimensional stability. The provision of such dimensional stability and an effective latex bond have apparently been found to be necessary to ensure that such carpet can be properly installed using the existing conventional tackless system without subjecting the carpet to the risk of being distorted, ripped apart or in some way unacceptably damaged. For these reasons a heavy basis weight secondary backing material is used.

This type of carpet also requires the prior installation of an underpad up to the edge of the tackless strip, but, more importantly, it is hard to handle because not only is it too stiff and lacking in maneuverability, but also it is very heavy. Under colder conditions, the carpet back becomes progressively stiffer, harder and less workable. Since the carpet is commonly manufactured in widths of 12 feet and frequently in lengths of one hundred feet, there is required a considerable amount of physical labour to carry pieces of the carpet about and to lay them correctly in the proper position.

In addition, the stretching of such a rigid carpet is a highly labour-intensive, skilled and difficult affair which involves the use of a power stretcher or knee kicker. Both require expertise to operate and it is possible to damage the carpet during this stretching process by either inserting the teeth too deeply into the carpet so that they grip and rip the underpad below the carpet, or by inserting the teeth too shallowly so that they scrape the primary backing off the carpet secondary backing, and rip or damage it. When the carpet is cold, it is difficult to get correct penetration of the teeth of the knee gripper into the carpet in order to properly stretch it.

The foam backed type of carpet, as it is called, has a Primary backing and a layer of foam or urethane bonded directly to the primary backing. However, such foam-backed carpet cannot be installed by the tackless method because the foam backing is not sufficiently strong to hold the pins of the tackless strips. Simply, the foam or urethane would rip and not hold if it were stretched onto the pins of a tackless installation.

Accordingly, foam-backed carpet products have been installed by cementing them down over the entire backing surface. Carpet installed by such procedures is often difficult to remove. The adhesive holds the foam; and when attempts are made to remove it, a delamination may occur in which the foam remains on the floor and the primary backing comes up. The resulting foam and adhesive is difficult to remove.

Also, the foam is liable to disintegrate, causing considerable difficulties. Sometimes in residential areas, foam-backed carpet is installed as a "loose-lay", being only held down by the re-installation of a quarter-round trim or by use of double sided adhesive tape.

Both loose-lay and double-sided adhesive tape do not generally hold such carpet down sufficiently, especially on heavy traffic areas or areas where heavy furniture is moved.

While foam-backed carpet has the advantage that it does not require an underpad and can usually be more readily installed, its installation techniques are not considered to be totally satisfactory because of the previously mentioned problems with gluing and taping.

A third type of carpet is a woven carpet in which the backing and the yarn are woven directly together. This type of carpet is usually installed in accordance with the same tackless method as the tufted carpet construction previously mentioned and suffers from some of the same drawbacks.

SUMMARY OF THE INVENTION

The present invention attempts to improve on both the construction and method of installation of tufted and woven carpets and the structure and method of installation of foam-backed carpet by providing a form of laminated carpet in combination with a new carpet anchoring product and a method of application thereof to a floor.

The laminated carpet can be manufactured of tufted yarn onto a primary backing in the conventional manner. However, a secondary backing is provided consisting preferably of a layer of polypropylene or other suitable man-made fiber in which a series of fine projecting strands or loops are needled. The secondary backing is positioned so that the strands or loops extend downwardly away from the pile of the carpet. The secondary backing is then laminated to the primary backing, being bonded by means of latex or other suitable adhesive to the back surface of the primary backing, such that the strands or loops of the secondary backing extend downwardly and the yarn of the pile extends upwardly. The secondary backing can be lightweight, as there is no requirement for great tearing strength as large stretching forces are not required in laying the carpet. However, heavier or lighter backings may be used depending on the situation.

With this construction, the downwardly projecting loops add additional tread resiliency to the carpet as well as Providing a method of affixing the carpet to the floor, as will be seen later. At the same time, owing to the characteristics of the carpet anchoring system, the undue rigidity of the carpet is no longer essential and a lighter, more flexible, construction results. Thus, in one example of the invention, the primary and secondary backing are attached together by the use of latex or an equivalent. However, because the means of installation of the carpet do not require the same rigidity, "clay" does not have to be mixed with the latex to make the tufted carpet rigid, as is often considered necessary in the case of the present tufted carpet.

In an alternative embodiment, a foam or urethane layer, with an appropriate bonding agent, if required, is placed between the forementioned primary and secondary backings. With the bonding agent, the foam can act both as an adhesive and as a layer to provide resiliency and stabilization to the carpet. The secondary backing is attached to the foam and has downwardly extending loops or strands in accordance with the invention. This structure enables foam carpet to be installed in accordance with the method disclosed below.

In accordance with the present invention there is provided a laminated carpet having enhanced stability in comparison with the former foam backed carpeting and having less weight and greater flexibility than the former tufted carpet while, in the preferred embodiment, possessing tread resiliency as a consequence of the provision of a layer of downwardly extending loops or strands to form the undersurface thereof. The subject carpet further enables the use of an intermediate foam layer if preferred located between the carpet primary backing layer wherein the pile is secured and the secondary backing layer by which the anchor loops or strands are attached. In this laminated carpet the primary backing is generally unchanged. Some changes in primary backing basis weight may be favourably affected, in view of the totally changed nature of the laminated carpet.

Polypropylene in woven and non-woven form and having a low basis weight is considered suitable for the secondary backing layer. The bonding agent requires little or no clay ballasting, leading to a more resilient and lighter laminated construction.

The present invention further provides in combination with the subject carpet an anchor system having, in the preferred embodiment, upstanding hook portions secured thereto for engaging the loops of the carpet in anchoring engagement. The anchor substrate preferably is coated with a contact adhesive on its face remote from the hook portions, having a peelable barrier paper adhering thereto in protective, removable relation. The upper face of the anchor system can also have a hookless area on which an adhesive can be coated to affix a protective peelable barrier on the upper face to prevent premature engagement of the hooks with the loops.

The anchor system generally is provided in strip form, having a width of one inch or greater, for jointing.

A heavy duty extruded plastic anchor strip to provide a more rigid system may incorporate foam in the adhesive system in order to facilitate installation on certain types of floors having uneven surfaces. Owing to the generally low profile of the strip and the fact that the hook portions penetrate upwardly in entering relation with the loops of the carpet, the presence of the anchor means beneath the carpet is comparatively inconspicuous particularly when compared with the relative thickness of the prior art nailing strips. This makes the anchor system substantially unnoticeable, and permits the anchor strip to be used in carpet stabilizing relation in areas additional to the carpet borders. Thus, the anchor strips can be used in stabilizing relation with the carpet in high traffic areas in the middle of a room or at carpet joints.

The nature of the hook portions, being formed in plastic, such as nylon filament to provide somewhat of a hook effect in cooperation with the strand or loop filaments of the carpet affords a break-free capability by which the carpet can be pulled upwardly when required clear of the anchor without damaging the hooks, the loops or the carpet.

The number of hooks per square inch of the anchor strip can be varied in accordance with the desired characteristics, both of the anchor and the looped carpet. It will be appreciated that this invention provides a great many advantages over the prior art, both in regard to the previously listed carpet characteristics, the capability of minimizing or dispensing with an underfelt or under pad, the provision of a resiliant loop or strand layer over the foam so as to protect the foam from damage and deterioration experienced with many foams and the capability to achieve the characteristics of a foam underpad as an interlayer with reduced likelihood of deterioration and no danger of undesired adhesion to the underlying floor surface.

It will also be appreciated that the hook elements could be installed on the secondary backing of the carpet and the loop elements on the anchor system, but with the presently designed hooks, this would not give the benefits of resiliency associated with the loops since the presently designed hooks are relatively harder and more brittle.

The subject anchor strip can be nailed to underlying floor surfaces if required. Generally, however, it is adhered by way of its own adhesive, pressure sensitive backing which lends itself to widespread utilization in a variety of environments. By simply peeling off the protective paper covering and pressing the adherent back surface thus exposed on to the available floor surface, the anchor type can be easily laid as required.

With the system used with this invention, conventional carpet joining by the use of hot melt tape, glue or nails would not be required. Thus no electricity or hot melt iron would be required on the site. Since the hot melt system will not be used, there would be no possibility of burning the top side of the carpet or spilling adhesive or glue.

An appropriately sized width of tape incorporating the anchor system (in the preferred embodiment-hooks) will be attached to the floor at either end or along its entire length. In the preferred embodiment, the upstanding hooks are protected by a peelable paper barrier until such time as fastening is required. The carpet is positioned along the seam. As fastening is required, in accordance with standard installation procedures, the paper barrier is removed and the carpet attached. Seams can be opened or closed at will as many times as needed for seam adjustment or restretching. If the tape is only fastened at the ends, the carpet is not therefore attached to the floor at the seams, and the seams are free to move as required during stretching.

The present invention further provides a system for attaching the laminated carpet to a floor area. The carpet having one portion of the anchorage combination incorporated into the carpet having anchorage elements facing downwardly to be positioned over a surface area having a complementary portion of the anchorage combination secured thereto with the anchorage elements facing upwardly. The carpet is then moved downwardly to bring the complementary anchorage components into mutual engaging relation to anchor the carpet.

In most instances the floor-attached portion of the anchorage combination comprises a tape of limited width and shallow depth having an adhesive underside portion which is brought into adhering relation with the adjoining floor surface.

In the case of certain uneven floor surfaces, the tape having hook elements extending upwardly thereof can be provided with a spongy resilient adhesive coated undersurface to achieve adhesion to the floor surface.

BRIEF DESCRIPTION OF THE DRAWINGS

Certain embodiments of the invention are described reference being made to the accompanying drawings wherein.

PREFERRED EMBODIMENT

Figure 1:
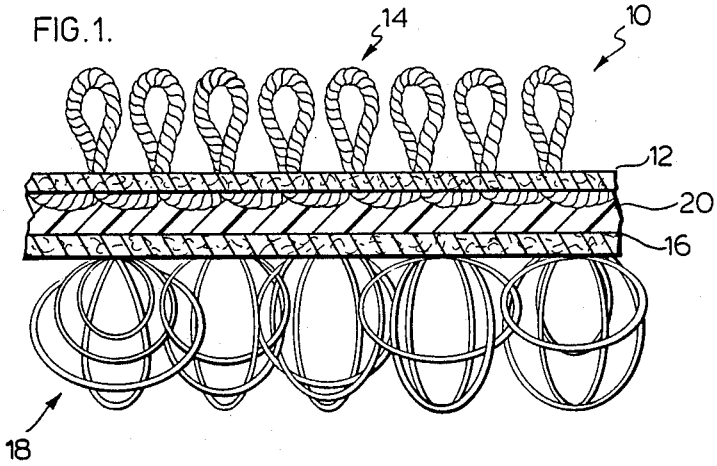
FIG. 1 is a sectional elevation of a first laminated carpet embodiment in accordance with the present invention.
Figure 3:
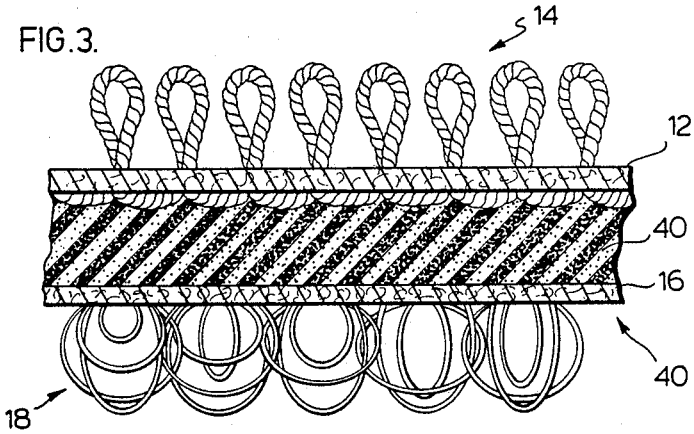
FIG. 3 is a view, similar to FIG. 1, of a laminated carpet embodiment incorporating a foam layer therewith.

Referring to the drawings, the two illustrated laminated carpet embodiments 10 and 40 (FIGS. 1 and 3) comprise a primary backing layer 12 into which is sewn a level loop pile 14. It will be understood that alternative pile formation, such as cut pile, plush, random shear, cut and loop, multi-level loop, and others, are substantially equally well suited to the present laminated construction. The loop pile 14 may be made of any presently used fibres such as nylon, acrylilon, antron (all trade marks for various man-made fibres) or natural fibres.

A secondary backing layer 16 has a layer of loops 18 needled into it, generally covering the whole of the back area of the carpet 10. It is preferable that the loops be applied to the entire undersurface to provide uniform resiliency, ease of manufacture and convenience of installation.

A binding layer 20 of latex serves to join the primary backing layer 12 to the secondary backing layer 16. In the FIG. 3 embodiment a foam layer 42, generally between 5 oz to 40 oz, per $ft^2$ is laminated between primary backing layer 12 and secondary backing layer 16.

The primary layer 12 and the secondary layer 16 will usually be of polypropylene or nylon.

Figure 2:
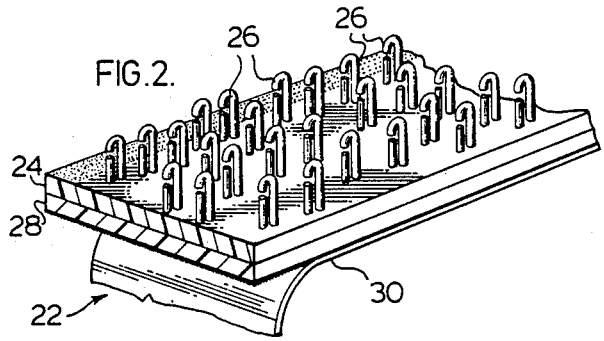
FIG. 2 is a general view of an anchor tape in accordance with the present invention.
Figure 4:
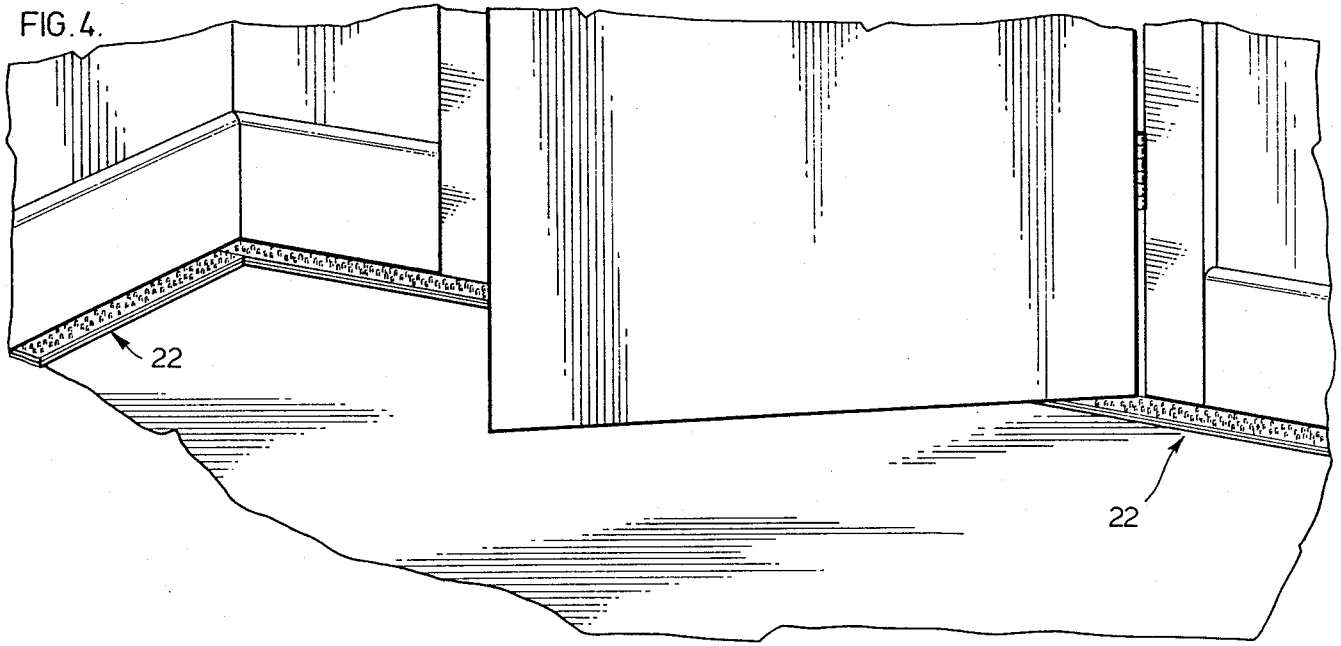
FIG. 4 is a prespective view of one area of a room with the anchor tape installed prior to installation of carpet.

Referring to FIG. 2, the anchoring means is illustrated as a tape 22 having an upper substrate 24 with a plurality of plastic hook portions 26 of suitable hooked profile upstanding therefrom. A contact adhesive layer 28 and protective strippable cover 30 provide a means to attach the tape to a floor when the cover is removed (FIG. 4). A protective strippable cover on the hooks (not shown) is a preferred option to be attached to an exposed hookless area by contact adhesive along one or both edges of the upper face to prevent, during installation, premature attachment of the hooks to the loops covering the back area of the carpet.

As previously mentioned, the position of the hooks and loops can be reversed, so that the hooks are on the underside of the carpet. However, this is not preferred because the loops, as presently shown, provide greater resiliency to the carpet than hooks.

What is claimed is:

1. A laminated carpet system for use in wall-to-wall installation in a location by cutting and fitting of the carpet to fit the contours of the location on-site and for attachment to a floor without a separate underpad comprising:

(i) a primary backing layer having pile element means substantially covering a first side of the primary backing, (ii) a secondary backing layer having loop element means substantially covering a first side of the secondary backing, (iii) means for securing the secondary backing layer to the primary backing so that the pile element means and loop means are exposed on abutting faces of the carpet, (iv) hook means on a first side of a separate or separable strip-like piece having means on a second opposite side for on-site attachment to the floor to attach such hook means to at least a portion of the loop element means on the secondary backing by engagement of the hook means into the loop means to hold such carpet to a floor;

(v) wherein, the carpet lamination is substantially free of stiffener so as not to require stretching in wall-to-wall applications by the use of mechanical devices.

2. A laminated carpet system as claimed in claim 1 wherein the means for securing the secondary backing layer to the primary backing includes an adhesive coated along substantially the entire surface of the second side of the primary backing to seal the pile element means into the primary backing.

3. A lamininated carpet system as claimed in claim 1 wherein the means for securing the secondary backing layer to the primary backing include a foam layer interposed between the primary backing layer and the secondary backing layer having adhesive and resilient cushioning properties.

4. The carpet system of claim 3 in which the foam layer is latex.

5. The carpet system of claim 3 in which the hook means are supplied separately as a tape of relatively narrow width.

6. The carpet system of claim 5 in which the on-site attachment means for the hook means is a pressure sensitive adhesive.

7. The carpet system of claim 6 in which the pressure sensitive adhesive on the hook means is coated with a release paper which prevents adhesion and which can be peeled and removed to enable the hook means to be attached to a floor.

8. The carpet systrem of claim 7 in which the hook means is further provided with cover hook means on the first side of the hook means so as to prevent premature attachment to the loop means.

9. The carpet system of claim 8 in which the first side of the hook means contains a hookless area and the hook cover means comprises a release paper attached to this area by pressure sensitive peelable adhesive and in which the paper extneds over the hook means to prevent premature attachment of the hooks with the loops.

10. The carpet system of claim in which the hook means are supplied separately as a tape of relatively narrow width.

11. The carpet system of claim 10 in which the on-site attachment means for the hook means is a pressure sensitive adhesive.

12. The carpet system of claim 11 in which the pressure sensitive adhesive on the hook means is coated with a release paper which prevents adhesion and which can be peeled and removed to enable the hook means to be attached to a floor.

13. The carpet system of claim 12 in which the hook means is further provided with cover hook means on the first side of the hook means so as to prevent premature attachment to the loop means.

14. The carpet system of claim 13 in which the first side of the hook means contains a hookless area and the hook cover means comprises a release paper attached to this area by a pressure sensitive peelable adhesive in which the paper extends over the hook means to prevent premature engagement of the hooks with the loops.

15. A laminated carpet system for use n wall-to-wall installation in a location by cutting and fitting of the carpet to fit the contours of the location on-site and for attachment to a floor without a separate underpad comprising:

(i) a primary backing having pile substantially covering a first side of the primary backing, (ii) a secondary backing having one part of a hook and loop attachment system substantially covering a first side of the secondary backing, (iii) adhesive means coated along substantially the entire surface of the second side of the primary backing to seal the pile into the primary backing and to attach the primary and secondary backing to each other, (iv) a separate second part of a hook and loop attachment system on a top side of a strip-like piece having pressure sensitive adhesive means on a bottom side of on-site attachment to the floor, (v) wherein the carpet lamination is substantially free of stiffener so as not to require stretching in wall-to-wall applications by the use of mechanical devices or tools.

16. A carpet laying system for laying a laminated wall-to-wall carpet substantially free of stiffening, having loops as a first part of an anchorage hook and loop combination integrally sewn into the entire back of the carpet, and the second portion of the hook and loop anchorage system comprising a tape detached from the carpet having an adhesive underside protected by a removable covering for securing the strips to the floor, and a top side having hooks protected by a detachable covering, comprising the steps of:

(a) positioning the carpet in a room and cutting and fitting the carpet to the contours of the location on-site, (b) folding back a portion of the carpet to expose a portion of the floor substantially at least along the edges and seams, (c) removing the removeable covering from the adhesive underside of the tape and attaching such tape to the floor, (d) manually stretching the carpeting into a desired overlapping position over the tape, (e) removing the detachable covering from the hooks and placing the carpet downwardly onto the loops to engage the hook and loop anchorage system, (f) repeating steps (b), (c), (d) and (e) as required to attach the carpet to the floor without mechanical stretching.

* * * * *

UNITED STATES PATENT AND TRADEMARK OFFICE

CERTIFICATE OF CORRECTION

PATENT NO. : 4,822,658

DATED : April 18, 1989

INVENTOR(S) : Pacione, Joseph R.

It is certified that error appears in the above-identified patent and that said Letters Patent is hereby corrected as shown below:

Col. 7, line 44, after the word "claim", insert --1--.

Signed and Sealed this

Sixteenth Day of March, 1993

*Attest:*

STEPHEN G. KUNIN

*Attesting Officer*

*Acting Commissioner of Patents and Trademarks*

US004822658B1

REEXAMINATION CERTIFICATE (3215th)

United States Patent [19] [11] B1 4,822,658

Pacione [45] Certificate Issued Jun. 10, 1997

[54] CARPET BACKING AND INSTALLATION SYSTEM

[76] Inventor: Joseph R. Pacione, 127 Elgin Street, Thornhill, Canada

Reexamination Request:
No. 90/003,966, Sep. 26, 1995

Reexamination Certificate for:

| | |
|---|---|
| Patent No.: | **4,822,658** |
| Issued: | **Apr. 18, 1989** |
| Appl. No.: | **136,953** |
| Filed: | **Dec. 23, 1987** |

Certificate of Correction issued Mar. 16, 1993.

[51] Int. Cl.[6] ..... B32B 3/00; B32B 32/00

[52] U.S. Cl. ..... 428/95; 428/40.1; 428/86; 428/100; 428/223

[58] Field of Search ..... 428/40.1, 86, 95, 428/100, 223

[56] References Cited

U.S. PATENT DOCUMENTS

| | | |
|---|---|---|
| 3,353,663 | 11/1967 | Kayser et al. . |
| 3,413,678 | 12/1968 | Krantz . |
| 3,583,057 | 6/1971 | Kolozsvary . |
| 3,600,261 | 8/1971 | Kerres . |
| 3,711,349 | 1/1973 | Snyder et al. . |
| 3,780,479 | 12/1973 | Billarant et al. . |
| 3,817,015 | 6/1974 | Frangos . |
| 4,012,544 | 3/1977 | Richards . |
| 4,041,667 | 6/1977 | Lindner et al. . |
| 4,090,335 | 5/1978 | Curatolo . |
| 4,114,346 | 9/1978 | Kelly . |
| 4,234,649 | 11/1980 | Ward . |
| 4,336,289 | 6/1982 | Davis . |
| 4,361,610 | 11/1982 | Roth . |
| 4,531,634 | 7/1985 | Lai Jung-Chi . |
| 4,557,774 | 12/1985 | Hoopengardner . |
| 4,635,418 | 1/1987 | Hobgood . |
| 4,647,484 | 3/1987 | Higgins . |
| 4,673,603 | 6/1987 | Roth . |
| 4,755,401 | 7/1988 | Friedrich et al. . |
| 4,758,457 | 7/1988 | Altus . |
| 4,769,895 | 9/1988 | Parkins . |
| 4,810,546 | 3/1989 | McLaughlin . |
| 4,824,498 | 4/1989 | Goodwin et al. . |
| 4,921,742 | 5/1990 | Altus . |
| 5,204,155 | 4/1993 | Bell et al. . |

FOREIGN PATENT DOCUMENTS

| | | |
|---|---|---|
| 323971 | 8/1975 | Austria . |
| 1034337 | 7/1978 | Canada . |
| 043714 | 1/1982 | European Pat. Off. . |
| 062738 | 10/1982 | European Pat. Off. . |
| 093008 | 11/1983 | European Pat. Off. . |
| 109941 | 5/1984 | European Pat. Off. . |
| 270888 | 6/1988 | European Pat. Off. . |
| 288393 | 10/1988 | European Pat. Off. . |
| 291868 | 11/1988 | European Pat. Off. . |
| 2220216 | 10/1974 | France . |
| 2368587 | 5/1978 | France . |
| 2377498 | 8/1978 | France . |
| 7029524 | 11/1970 | Germany . |

(List continued on next page.)

OTHER PUBLICATIONS

Mad Magazine, 1984, pp. 40 & 41 (United States).
Popular Science Magazine, p. 113, Aug. 1964 (United States).

*Primary Examiner*—Terrel Morris

[57] ABSTRACT

A novel carpet construction provides a secondary backing layer adhered to the primary backing layer in which the carpet pile is secured. The secondary backing layer incorporates a layer of downwardly depending loops which can serve as a resilient undersurface, in the manner of an underpad, and also to secure the laminated carpet structure to the floor. A hooked type construction used in combination with the subject carpet has a plurality of upwardly extending hooks to engage the looped layer of the carpet, and an adherent under surface, for making adhesive contact with the floor surface. The carpet construction can include a foam interlayer sandwiched between the primary and the secondary backing layers. The hooked tape can be laid as a perimeter attachment surface, or in intermediate locations also.

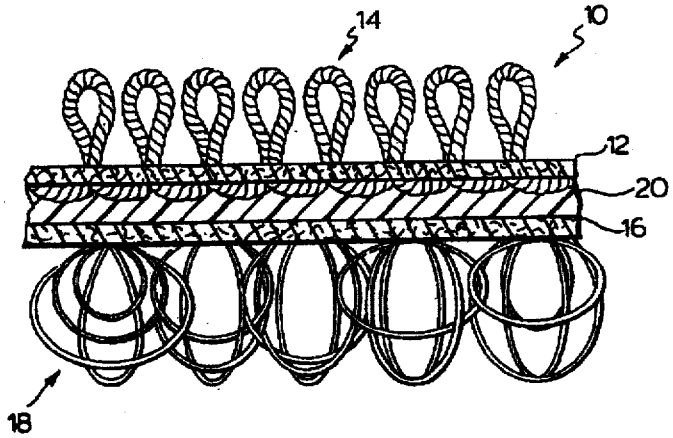

FOREIGN PATENT DOCUMENTS

| | | |
|---|---|---|
| 2201231 | 7/1973 | Germany . |
| 2803006 | 8/1979 | Germany . |
| 48-88732 | 2/1973 | Japan . |
| 49-34519 | 3/1974 | Japan . |
| 50-127222 | 10/1975 | Japan . |
| 51-18129 | 2/1976 | Japan . |
| 51-43827 | 4/1976 | Japan . |
| 52-139229 | 11/1977 | Japan . |
| 53-62332 | 6/1978 | Japan . |
| 53-74719 | 7/1978 | Japan . |
| 53-74720 | 7/1978 | Japan . |
| 54-3341 | 1/1979 | Japan . |
| 54-10525 | 1/1979 | Japan . |
| 54-136725 | 10/1979 | Japan . |
| 54-149228 | 11/1979 | Japan . |
| 55-81618 | 6/1980 | Japan . |
| 55-99223 | 7/1980 | Japan . |
| 55-136303 | 10/1980 | Japan . |
| 56-18817 | 2/1981 | Japan . |
| 56-60514 | 5/1981 | Japan . |
| 56-70723 | 6/1981 | Japan . |
| 57-20280 | 2/1982 | Japan . |
| 57-20281 | 2/1982 | Japan . |
| 57-64016 | 4/1982 | Japan . |
| 57-122815 | 7/1982 | Japan . |
| 58-54914 | 4/1983 | Japan . |
| 58-58019 | 4/1983 | Japan . |
| 58-149712 | 9/1983 | Japan . |
| 59-15156 | 1/1984 | Japan . |
| 59-44216 | 3/1984 | Japan . |
| 59-81479 | 6/1984 | Japan . |
| 59-108576 | 6/1984 | Japan . |
| 59-137180 | 9/1984 | Japan . |
| 60-106410 | 6/1985 | Japan . |
| 60-132575 | 7/1985 | Japan . |
| 60-156417 | 8/1985 | Japan . |
| 60-175603 | 9/1985 | Japan . |
| 61-68012 | 4/1986 | Japan . |
| 61-168307 | 7/1986 | Japan . |
| 63-107241 | 7/1988 | Japan . |
| 52-7594 | 10/1972 | Switzerland . |
| 518590 | 3/1940 | United Kingdom . |
| 1174639 | 12/1969 | United Kingdom . |
| 1204886 | 9/1970 | United Kingdom . |
| 1341817 | 12/1973 | United Kingdom . |
| 1376262 | 12/1974 | United Kingdom . |
| 1472729 | 5/1977 | United Kingdom . |
| 1546901 | 5/1979 | United Kingdom . |
| 1573492 | 8/1980 | United Kingdom . |
| 2083352 | 3/1982 | United Kingdom . |
| 2111106 | 6/1983 | United Kingdom . |
| 2142842 | 1/1985 | United Kingdom . |
| 2188080 | 9/1987 | United Kingdom . |
| 2197357 | 5/1988 | United Kingdom . |
| 86/01247 | 2/1986 | WIPO . |
| 86/03164 | 6/1986 | WIPO . |

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1–16 is confirmed.

Claim 17 was presented as a new claim but was subsequently cancelled.

* * * * *